US011197519B2

(12) United States Patent
Dombrow et al.

(10) Patent No.: US 11,197,519 B2
(45) **Date of Patent: *Dec. 14, 2021**

(54) FOOTWEAR WITH INTERNAL HARNESS

(71) Applicant: Under Armour, Inc., Baltimore, MD (US)

(72) Inventors: David Dombrow, Portland, OR (US); Evan Caruso, Baltimore, MD (US)

(73) Assignee: UNDER ARMOUR, INC., Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/813,043

(22) Filed: Mar. 9, 2020

(65) Prior Publication Data

US 2020/0205521 A1 Jul. 2, 2020

Related U.S. Application Data

(63) Continuation of application No. 15/815,978, filed on Nov. 17, 2017, now Pat. No. 10,588,381.
(Continued)

(51) Int. Cl.

| | |
|---|---|
| ***A43B 23/07*** | (2006.01) |
| ***A43B 23/02*** | (2006.01) |
| ***A43B 5/02*** | (2006.01) |
| ***A43B 7/14*** | (2006.01) |
| ***A43B 7/22*** | (2006.01) |
| ***A43B 7/20*** | (2006.01) |
| ***A43B 5/06*** | (2006.01) |
| *A43C 11/12* | (2006.01) |

(52) U.S. Cl.
CPC ..... *A43B 23/0275* (2013.01); *A43B 5/02* (2013.01); *A43B 5/06* (2013.01); *A43B 7/1405* (2013.01); *A43B 7/1495* (2013.01); *A43B 7/20* (2013.01); *A43B 7/223* (2013.01); *A43B 7/226* (2013.01); *A43B 23/07* (2013.01); *A43C 11/12* (2013.01)

(58) Field of Classification Search
CPC ..... A43B 7/1495; A43B 7/14; A43B 23/07; A43B 23/26; A43C 7/08; A43C 11/165
USPC ..... 36/50.1, 55, 169, 170, 91, 54
See application file for complete search history.

(56) References Cited

U.S. PATENT DOCUMENTS

| | | | |
|---|---|---|---|
| 325,280 | A | 9/1885 | Smadbeck et al. |
| 1,269,518 | A | 6/1918 | Gain |

(Continued)

FOREIGN PATENT DOCUMENTS

| | | | |
|---|---|---|---|
| WO | 8910731 | A1 | 11/1989 |
| WO | 9831247 | A1 | 7/1998 |
| WO | 2009112814 | A2 | 9/2009 |

*Primary Examiner* — Marie D Bays
(74) *Attorney, Agent, or Firm* — Edell, Shapiro & Finnan LLC

(57) ABSTRACT

An improved article of footwear is disclosed herein. The article of footwear includes an upper and a harness. The upper has a midfoot region, a forefoot region, a medial side, a lateral side, and an opening configured to receive a foot of a wearer. The harness extends between the midfoot region and the forefoot region, and includes a panel, a cable, and a tightening mechanism. The tightening mechanism tensions the cable against the panel to apply a compressive force to the foot of a wearer to secure the foot of the wearer in the upper. Consequently, the internal harness prevents the foot of a wearer from shifting or translating in the upper, such as during athletic activity like cutting.

17 Claims, 10 Drawing Sheets

Related U.S. Application Data

(60) Provisional application No. 62/424,685, filed on Nov. 21, 2016.

(56) References Cited

U.S. PATENT DOCUMENTS 1,286,787 A 12/1918 Rokahr
1,927,666 A 9/1933 Laible
2,116,445 A * 5/1938 Moore ..... A43B 7/00 36/170
2,191,210 A * 2/1940 Johnson ..... A43B 5/16 36/170
2,530,637 A 11/1950 Taylor
2,591,211 A 4/1952 Spencer
2,798,309 A 7/1957 Wustemann
3,327,410 A 6/1967 Park, Sr. et al.
4,064,642 A 12/1977 Vykukal et al.
4,313,433 A 2/1982 Cramer
4,366,634 A 1/1983 Giese et al.
4,550,511 A 11/1985 Gamm
4,621,648 A 11/1986 Ivany
4,640,025 A 2/1987 DeRenzo
4,649,939 A 3/1987 Curtis
4,794,706 A * 1/1989 Puckhaber ..... A43B 3/26 36/91
4,811,500 A 3/1989 Maccano
4,860,464 A 8/1989 Misevich et al.
4,878,504 A 11/1989 Nelson
4,926,569 A 5/1990 Bunch
5,067,486 A 11/1991 Hely
5,090,138 A 2/1992 Borden
5,226,875 A 7/1993 Johnson
5,269,078 A 12/1993 Cochrane
5,337,493 A 8/1994 Hill
5,341,583 A 8/1994 Hallenbeck
5,366,439 A 11/1994 Peters
5,400,529 A 3/1995 Bell et al.
5,408,761 A 4/1995 Gazzano
5,499,461 A 3/1996 Danezin et al.
5,566,475 A * 10/1996 Donnadieu ..... A43B 5/00 36/55
5,676,641 A 10/1997 Arensdorf et al.
5,704,138 A * 1/1998 Donnadieu ..... A43B 5/002 36/50.1
5,704,140 A 1/1998 Fields
5,771,608 A 6/1998 Peterson
5,802,742 A 9/1998 Baude et al.
5,826,353 A 10/1998 Woznicki
5,832,636 A 11/1998 Lyden et al.
5,865,778 A 2/1999 Johnson
5,940,990 A 8/1999 Barret
5,946,827 A 9/1999 Okajima
5,966,841 A 10/1999 Barret
6,079,124 A 6/2000 Dalvy
6,117,098 A 9/2000 Weber et al.
6,272,772 B1 8/2001 Sherman
6,663,583 B1 12/2003 Janis
6,691,434 B1 2/2004 Couturier
6,793,640 B1 9/2004 Avon
6,877,257 B2 4/2005 Delgorgue et al.
6,925,734 B1 * 8/2005 Schaeffer ..... A43B 7/1495 36/166
6,952,891 B2 10/2005 Hirayama
7,013,586 B1 3/2006 Hatfield et al.
7,094,213 B1 8/2006 Cook
7,159,340 B2 1/2007 Borsoi
7,171,766 B2 2/2007 Bouche et al.
7,219,444 B2 5/2007 Hall
7,386,947 B2 6/2008 Martin et al.
7,490,417 B2 2/2009 Petrie
7,618,388 B1 11/2009 Chan
7,753,865 B1 7/2010 Hely
7,818,899 B2 10/2010 Dinndorf et al.
8,857,077 B2 10/2014 Kahatsu et al.
9,078,490 B2 7/2015 Gerber et al.
9,480,299 B2 11/2016 Dinndorf et al.
10,588,381 B2 * 3/2020 Dombrow ..... A43B 7/226
2002/0050076 A1 5/2002 Borsoi et al.
2003/0079376 A1 5/2003 Oorei et al.
2003/0097766 A1 5/2003 Morgan
2003/0115777 A1 6/2003 Hall et al.
2004/0159017 A1 * 8/2004 Martin ..... A43C 1/00 36/50.5
2004/0250452 A1 12/2004 Farys
2005/0115109 A1 6/2005 Goldman
2006/0075661 A1 4/2006 Ramsey
2006/0084899 A1 4/2006 Verkade et al.
2006/0137226 A1 6/2006 Jung et al.
2006/0185193 A1 8/2006 Pellegrini
2006/0191164 A1 8/2006 Dinndorf et al.
2006/0196083 A1 9/2006 Martin et al.
2006/0270958 A1 11/2006 George
2006/0283048 A1 12/2006 Lebo
2007/0169380 A1 7/2007 Borsoi
2008/0052962 A1 3/2008 Battilana
2008/0078102 A1 * 4/2008 Kilgore ..... A43C 1/00 36/50.1
2008/0110059 A1 5/2008 Kuramoto et al.
2008/0168685 A1 7/2008 Kim et al.
2008/0235995 A1 10/2008 Reagan et al.
2008/0313926 A1 12/2008 Kelley
2009/0071037 A1 3/2009 Foxen et al.
2009/0107012 A1 4/2009 Chenehy et al.
2009/0112140 A1 4/2009 Gaylord et al.
2009/0247920 A1 10/2009 Clements et al.
2009/0300947 A1 12/2009 Babolat
2010/0263236 A1 10/2010 Carboy et al.
2010/0304937 A1 12/2010 Spencer
2011/0000103 A1 1/2011 Hahn
2011/0010965 A1 1/2011 Shepherd et al.
2011/0088283 A1 * 4/2011 Berthet ..... A43B 5/0411 36/50.1
2011/0258876 A1 * 10/2011 Baker ..... A43C 11/1493 36/50.1
2011/0308108 A1 12/2011 Berns et al.
2012/0011744 A1 1/2012 Bell et al.
2016/0058127 A1 3/2016 Burns et al.
2016/0242498 A1 8/2016 Sakamoto et al.
2016/0262496 A1 9/2016 Midorikawa
2016/0309844 A1 10/2016 Smith et al.
2016/0324257 A1 11/2016 Ko et al.
2016/0353835 A1 12/2016 Hesterberg et al.
2017/0079372 A1 4/2017 Duarte
2017/0172248 A1 * 6/2017 Fadil ..... A43B 7/20

* cited by examiner

FOOTWEAR WITH INTERNAL HARNESS

CROSS-REFERENCE TO RELATED APPLICATIONS

This application claims priority to U.S. patent application Ser. No. 15/815,978, entitled "Footwear with Internal Harness," filed Nov. 17, 2017, which claims priority, under 35 U.S.C. 119(e), to U.S. Provisional Patent Application Ser. No. 62/424,685, entitled "Footwear with Internal Harness," filed Nov. 21, 2016. The disclosures of each of these applications are incorporated herein by reference in its entirety for all purposes.

FIELD OF THE INVENTION

The present invention relates to an article of footwear, and, in particular, footwear including a harness disposed within an upper and configured to lock a wearer's foot into a bed of the footwear to increase speed and stability of the wearer while preventing unwanted shifting or translating of the wearer's foot within a cavity of the footwear.

BACKGROUND OF THE INVENTION

Footwear, particularly athletic footwear, is worn in a variety of activities including running, walking, hiking, team and individual sports, and any activity where the protection and/or support of human feet is desired. Articles of footwear typically include an upper affixed upon a sole structure, where the upper is configured to wrap around and contour to the foot of a wearer while simultaneously securing the footwear to the foot. Often, the upper is formed from materials that provide at least some flexibility so that the footwear is comfortable to wear and can be easily taken on and off. However, this flexibility may also allow a foot to shift and/or slide within the upper. Shifting and/or sliding are often undesirable because this movement may negatively impact a foot (e.g., cause black toe or other medical conditions). Moreover, shifting and/or sliding is particularly undesirable for athletes when cutting, sprinting, or otherwise moving quickly. If an athlete's foot slides within his or her footwear while making a cut, this slide may reduce or otherwise negatively impact the athlete's speed and/or stability.

In order to reduce sliding and/or shifting, users (e.g., athletes) will often try to tighten the laces on their footwear. Additionally or alternatively, a user may attempt to tighten a portion of footwear by wrapping tape, adhesive bandages, or other such items around a shoe in an attempt to create external pressure on the footwear and foot. However, these options may create additional issues. For example, external (e.g. exposed) laces, bandages, tape, etc. may alter the contour of the footwear. In sports, such as soccer, where a user must use their feet to contact a ball (or other such object), external laces, bandages, tape, etc. may create unwanted spin or otherwise alter the direction of a kicked ball, and, thus, negatively impact performance. Moreover, it is often quite difficult to tighten footwear with laces, bandages, tape, etc. to a specific fit, as the user (e.g., athlete) is often trying to perform fine motor functions (e.g., pulling and/or tying) while bent or hunched over. Repeated taping or wrapping is also time and resource (e.g., tape) consuming and requires a user to restart the process if the taping or wrapping is inadequate or uncomfortable. Accordingly, it would be desirable to provide an article of footwear (e.g., for athletic activities) having an upper with an internal harness that is easily operable to lock a foot to a bed to prevent unwanted shifting of the foot within a cavity, thereby increasing speed and stability of the footwear.

SUMMARY OF THE INVENTION

An article of footwear according to the present invention includes an upper and an internal harness disposed within the upper. The upper has a midfoot region, a forefoot region, a medial side, a lateral side, and an opening configured to receive a foot of a wearer. The harness extends between the midfoot region and the forefoot region, and includes a medial panel and a lateral panel. The medial panel and the lateral panel are coupled to the upper and movably coupled to each other. Moving the lateral panel and the medial panel together applies a compressive force to the foot of a wearer to secure the foot of the wearer in the upper. Consequently, the internal harness prevents the foot of a wearer from shifting or translating in the upper, such as during athletic activity like cutting.

According to another embodiment, an article of footwear includes an upper having a bed and a harness disposed within the upper. The upper defines an interior cavity configured to receive a foot of a wearer and the bed of the upper has a medial side and a lateral side. The harness includes an inner layer and an outer layer. The inner layer is coupled to the medial side and the lateral side of the bed. The outer layer is coupled to the medial side and the lateral side of the bed and extends over the inner layer. Moreover, the outer layer is configured to apply a compressive force to the inner layer to secure the foot of the wearer to the bed of the upper.

According to yet another embodiment, an internal harness for an article of footwear is provided herein. The internal harness includes a cushioning layer and a compressive layer. The cushioning layer is coupleable to a medial side and a lateral side of an upper and the compressive layer is disposed over the cushioning layer. The compressive layer includes a medial panel and a lateral panel. The medial panel is coupleable to the medial side of the upper and the lateral panel is coupleable to the lateral side of the upper. The lateral panel is also movably coupled to the medial panel. Moving the lateral panel and the medial panel together applies a compressive force to the foot of a wearer to secure the foot of the wearer in the upper.

In at least some of the aforementioned embodiments, each of the medial panel and the lateral panel includes a bottom edge coupled to the bed of the upper and an opposite mating edge. The mating edges of the medial panel and the lateral panel are configured to be movably coupled or mated together, such as with laces or a cable, so that movement of the outer layer (e.g., the medial panel and the lateral panel) creates the compressive force. The internal harness imparts this compressive force to the foot to lock the foot in the bed and prevent the foot from shifting within the upper.

Moreover, in some of the aforementioned embodiments, the internal harness is not disposed in a strike area of the article of footwear within which it is included. With this configuration and construction, the desired performance characteristics of an upper of an article of footwear can be more easily implemented into an article of footwear without decreasing other desired performance characteristics or increasing undesired performance characteristics. For example, the internal harness can be easily tightened to a desirable tightness without negatively impacting the outer contour of the upper. Moreover, in at least some embodiments, the internal harness includes a tightening mechanism positioned to allow a wearer to easily use the internal harness (e.g., the position is biomechanically efficient).

The above and still further features and advantages of the present invention will become apparent upon consideration of the following detailed description of specific embodiments thereof.

BRIEF DESCRIPTION OF THE DRAWINGS

Like reference numerals have been used to identify like elements throughout this disclosure.

DETAILED DESCRIPTION OF THE INVENTION

Figure 1:
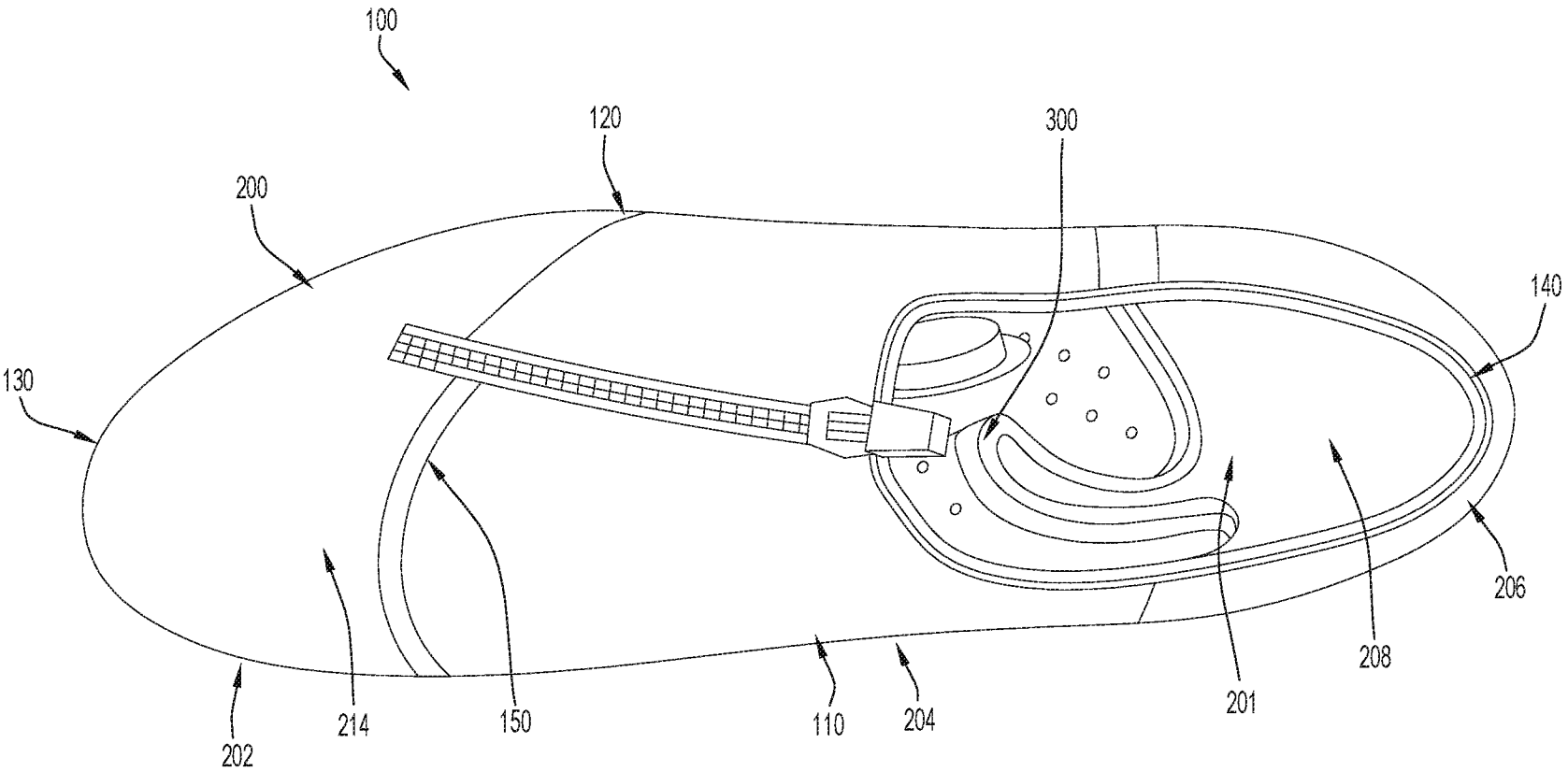
FIG. 1 illustrates a top view of an embodiment of an article of footwear according to the present invention.
Figure 2:
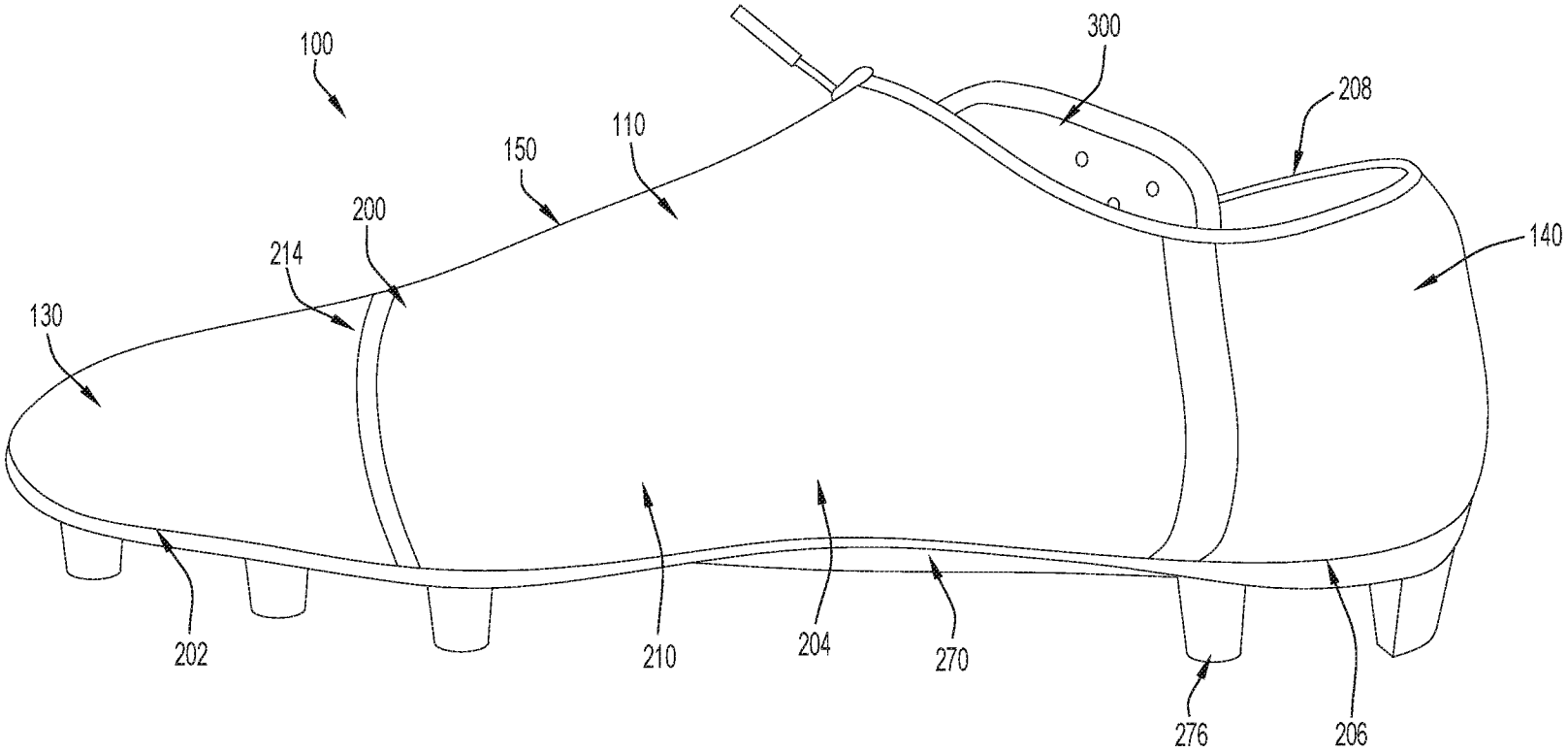
FIG. 2 illustrates a side view of the medial side of the embodiment of the article of footwear of FIG. 1.
Figure 3:
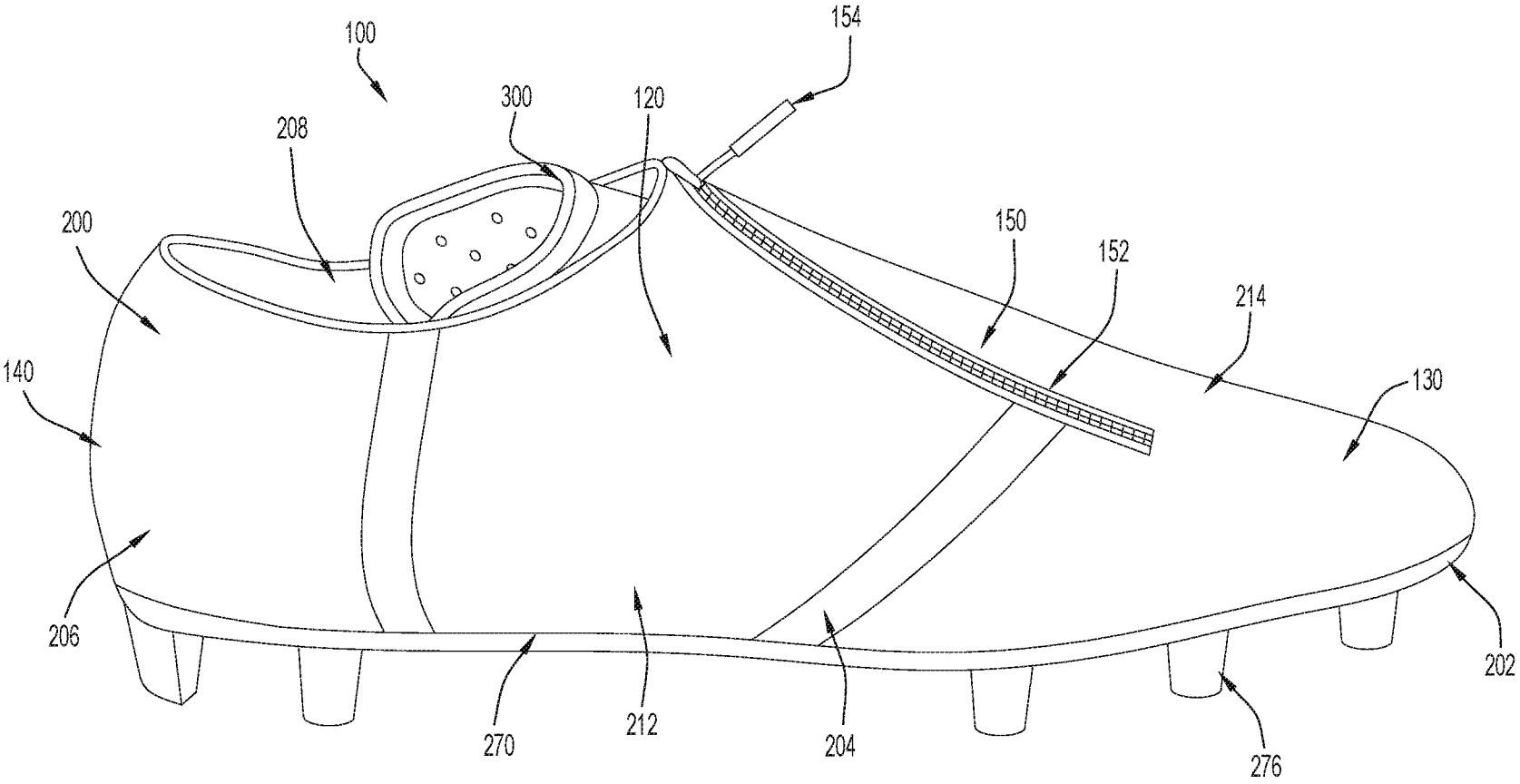
FIG. 3 illustrates a side view of the lateral side of the embodiment of the article of footwear of FIG. 1.
Figure 4:
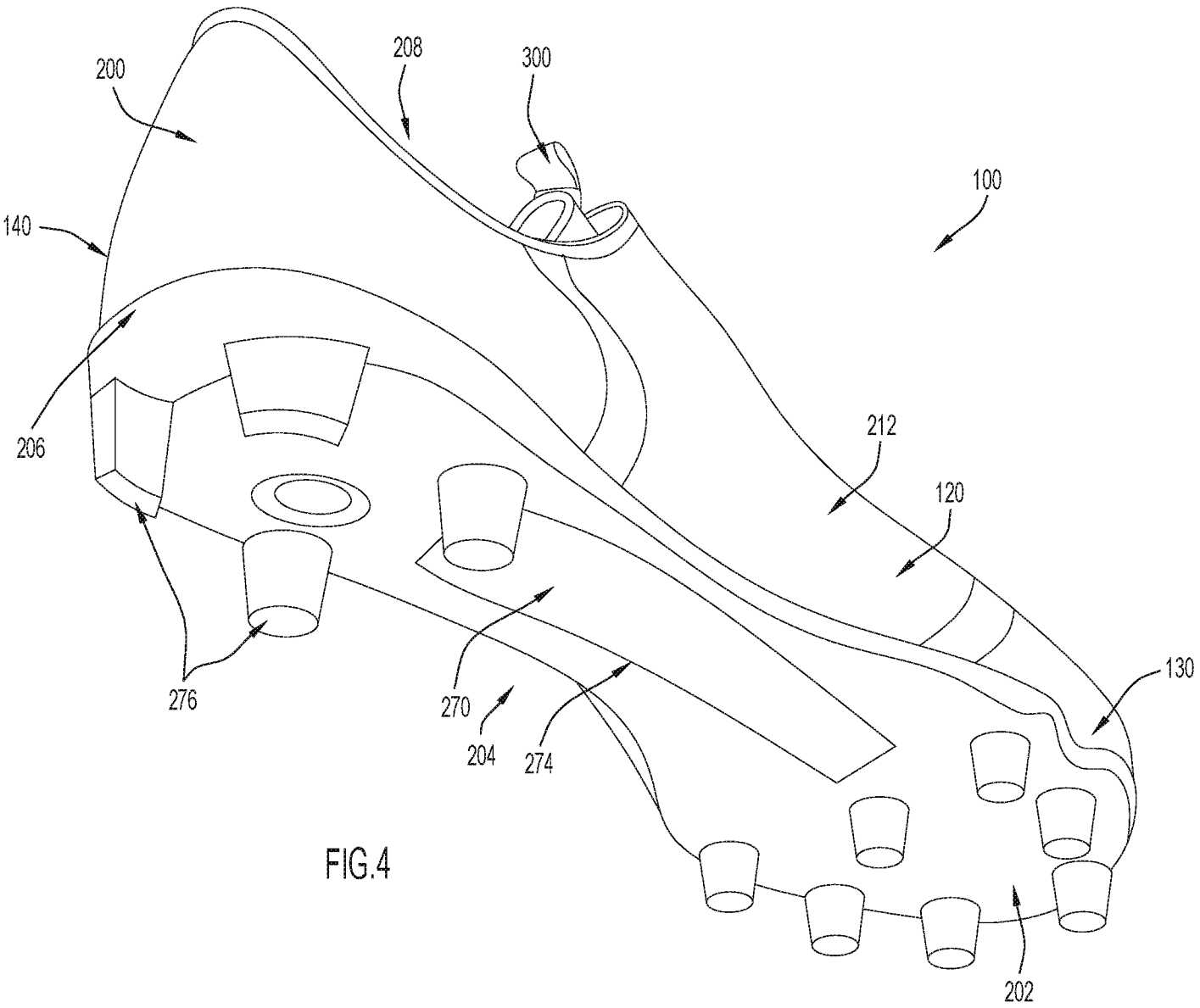
FIG. 4 illustrates a bottom perspective view of the embodiment of the article of footwear of FIG. 1.
Figure 5:
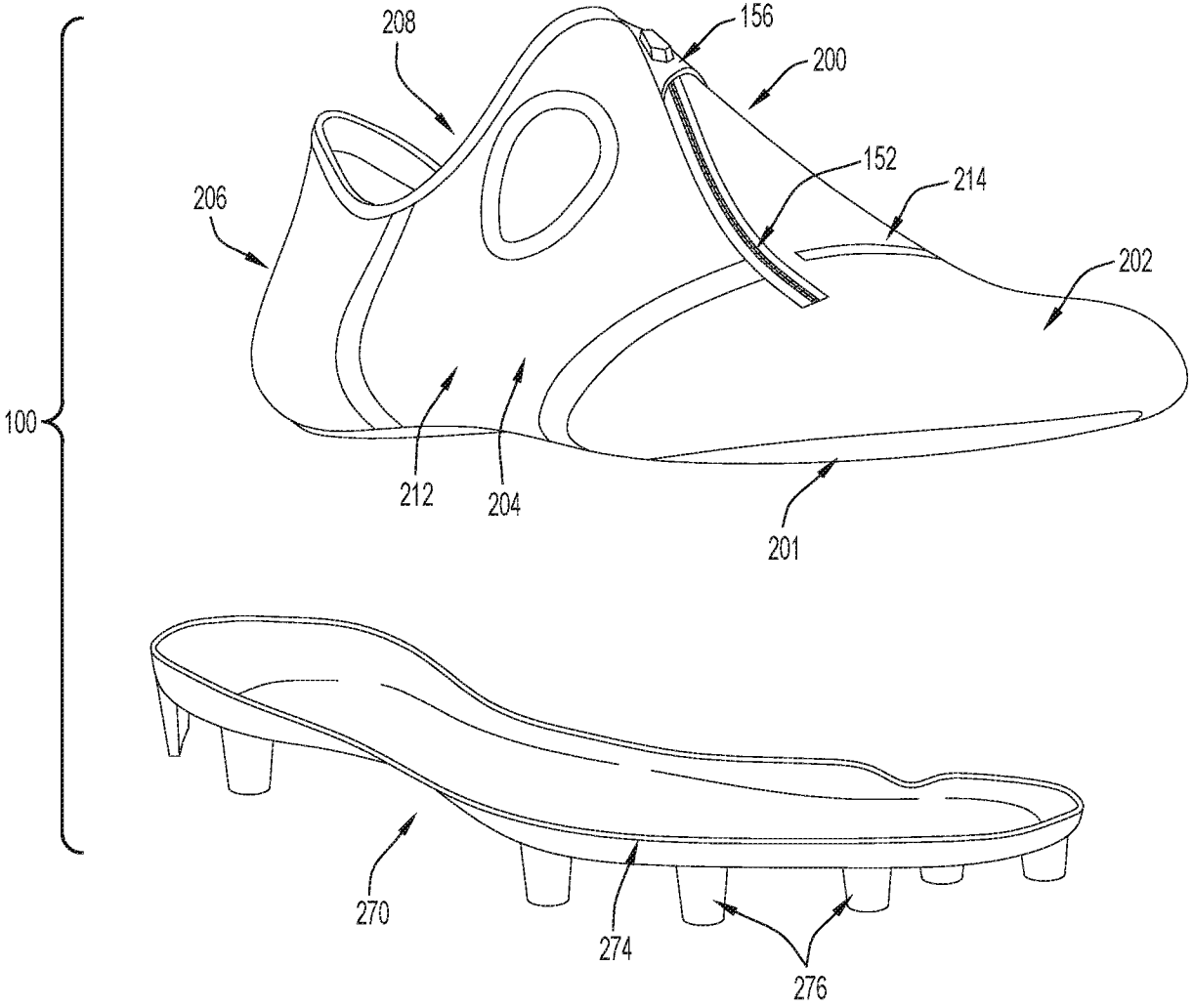
FIG. 5 illustrates an exploded, lateral side perspective view, with a sole removed from an upper of the embodiment of the article of footwear of FIG. 1.

As described herein with reference to the example embodiments of FIGS. 1-11, an article of footwear 100 in accordance with the invention includes an upper 200 that is coupled to a sole structure 270 and includes or houses an internal harness 300, 400. The article of footwear 100, also referred to herein as a shoe, can be in the form of a soccer cleat (e.g., a soccer "boot") or other type of athletic shoe. As is described in further detail herein, the internal harness 300, 400 is disposed within or beneath the upper 200, so that the internal harness 300, 400 is substantially hidden when the shoe 100 is worn by a wearer (i.e., the harness is covered by or disposed beneath the upper, at least during use of the footwear). The internal harness 300, 400 supports a wearer's foot within the upper 200 by locking the wearer's foot to the sole structure 270 (and a bed of the upper 200). This prevents the wearer's foot from translating forwards or backwards or otherwise shifting while also locking the wearer's heel into a heel of the shoe. Locking the wearer's foot in this manner increases the speed and stability of the wearer in and out of cuts, as well as during, before, and after other quick movements. In at least some embodiments, the internal harness 300, 400 is also designed so that the internal harness 300, 400 does not interfere with the use of a shoe 100 (e.g., does not negatively impact the outer or external surfaces of a soccer cleat) and so that the user can adjust the internal harness 300, 400 in a natural biomechanical position.

Figure 9:
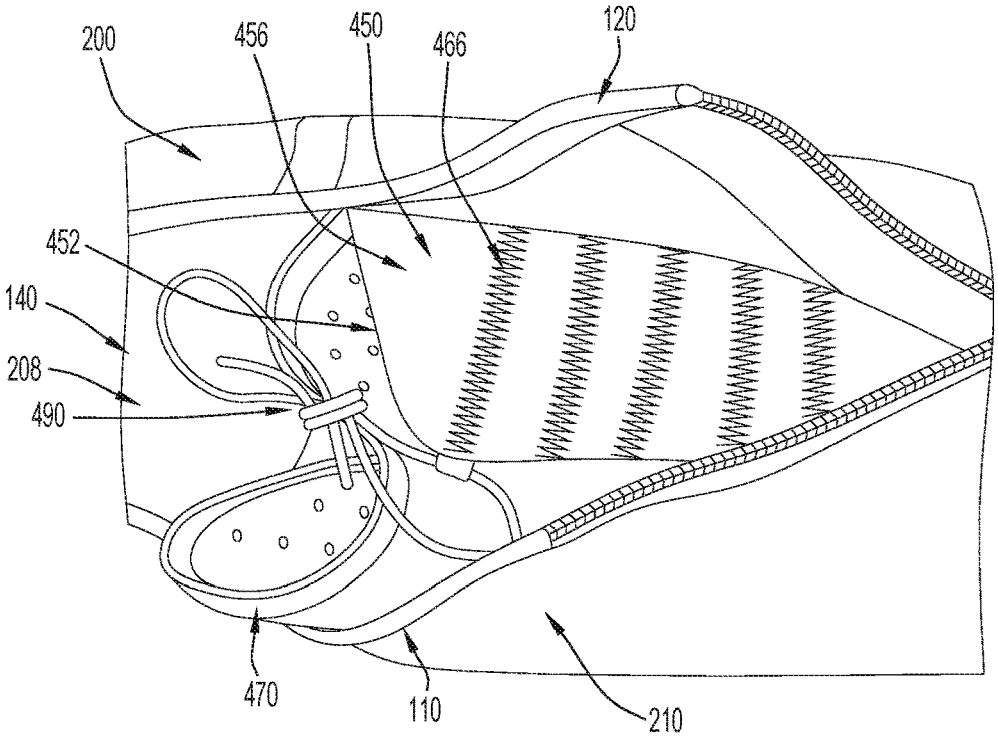
FIG. 9 illustrates a top perspective view of another embodiment of an article of footwear according to the present invention, with a first portion of the internal harness exposed to show a lateral panel of an external layer of an internal harness.
Figure 10:
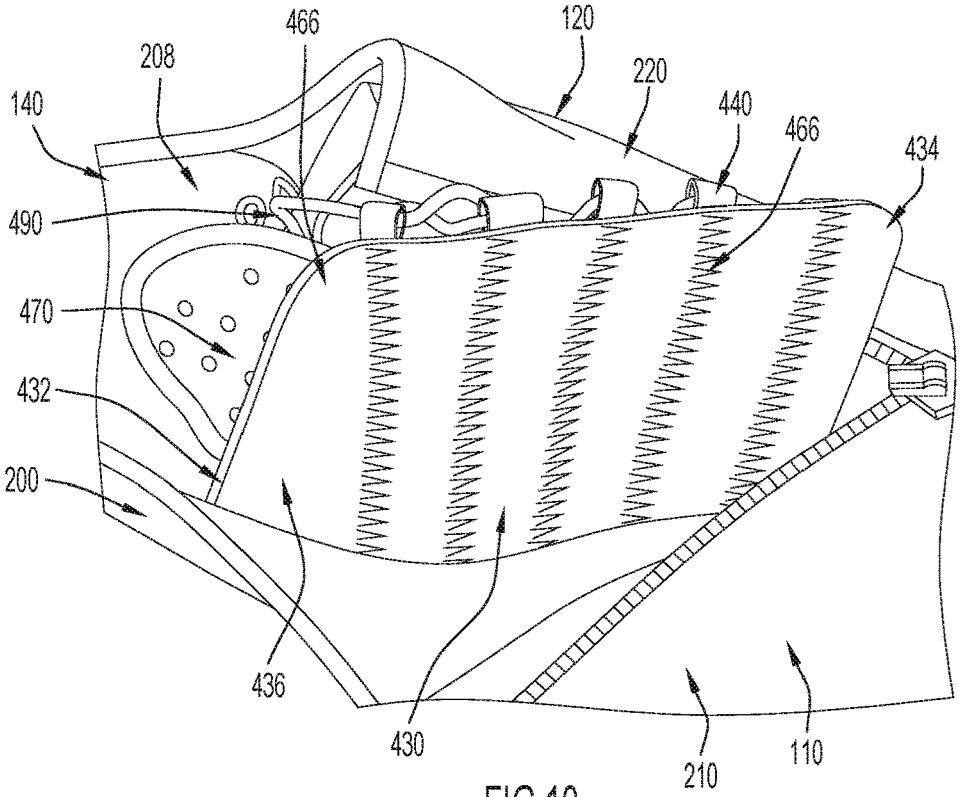
FIG. 10 illustrates a top perspective view of the article of footwear of FIG. 9 with a second portion of the internal harness exposed to show a medial panel of an external layer of the internal harness.
Figure 11:
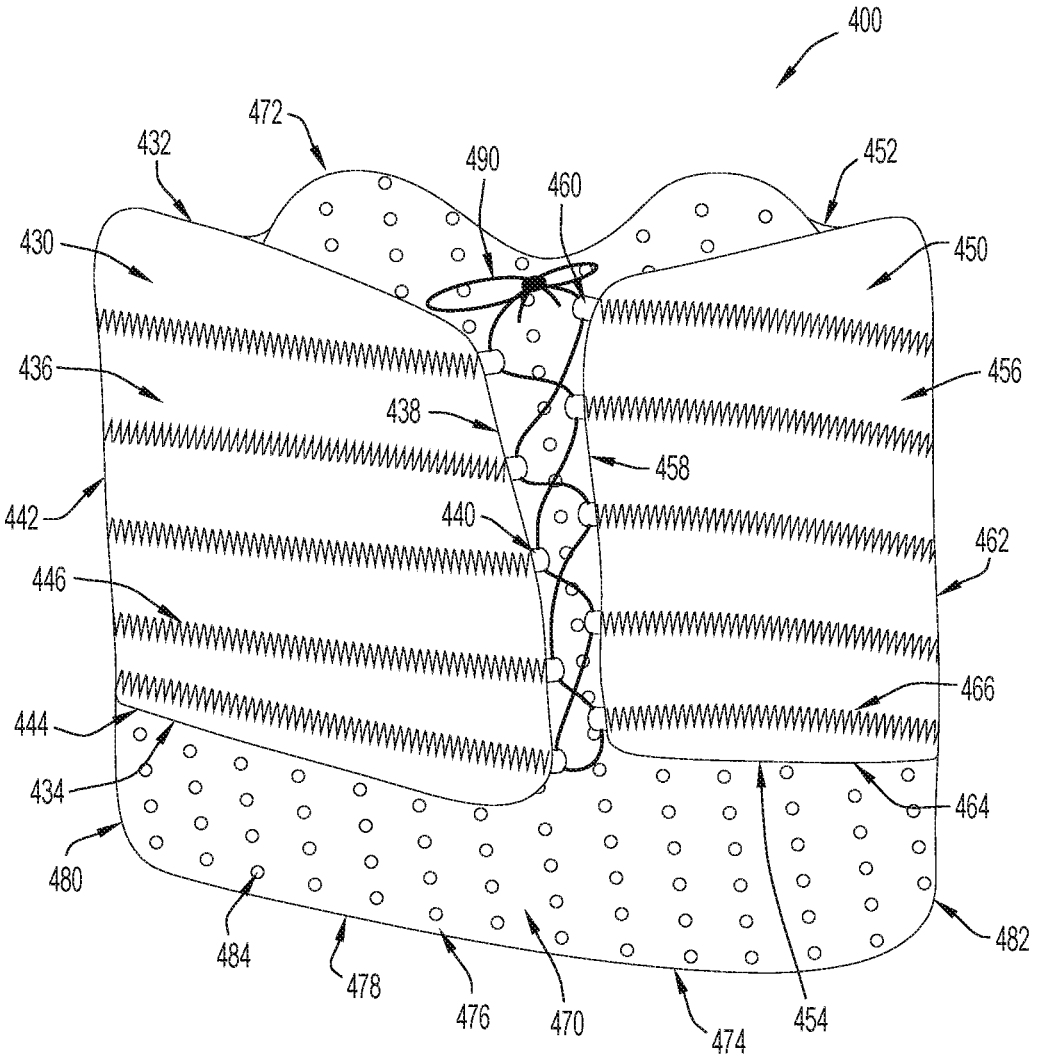
FIG. 11 illustrates a top view of the internal harness from the footwear of FIG. 9 while laying flat and removed from the upper.

While many of the example embodiments depicted in the figures (including FIGS. 1-5) show an article of footwear (shoe) configured for a right foot, it is noted that the same or similar features can also be provided for an article of footwear (shoe) configured for a left foot (where such features of the left footed shoe are a reflection or "mirror image," symmetrical in relation to the right footed shoe, e.g., the embodiment depicted in FIGS. 1-5). For example, FIGS. 9-11 depict an alternate embodiment on a left footed shoe.

Now referring to FIGS. 1-5, regardless of the foot configuration of the shoe 100, the shoe 100 includes a medial side 110 that is oriented along the medial or big toe side of the wearer's foot, a lateral side 120 that is oriented along the lateral or little toe side of the wearer's foot, a toe (e.g., front) end 130 that corresponds with the toe end of the wearer's foot and a heel (e.g., rear) end 140 that corresponds with the heel of the wearer's foot. The shoe 100 further includes a top side 150 that is oriented between the medial side 110, the lateral side 120, the toe end 130, and the heel end 140.

The upper 200 defines an envelope or pocket that covers and protects the foot of the wearer. In some embodiments, the upper 200 covers and protects the foot of the wearer together with the sole structure 270; however, in the depicted embodiments, the upper 200 includes a bed 201 (see, e.g., FIGS. 1 and 5), such that the upper 200 forms an enclosure to cover and protect the foot on its own. The upper 200 may include a forefoot region 202 that generally aligns with the ball and toes of a wearer's foot (e.g., when a user is wearing the shoe), a midfoot region 204 that generally aligns with the arch and instep areas of the wearer's foot, and a hindfoot region 206 that generally aligns with the heel and ankle areas of the wearer's foot.

Still referring to FIGS. 1-5, the upper 200 may further include a medial quarter 210 that extends from the hindfoot region 206 to the forefoot region 202 along the medial side 110 of the shoe 100 and a lateral quarter 212 that extends from the hindfoot region 206 to the forefoot region 202 along the lateral side 120 of the shoe. Additionally, the upper 200 may include an opening 208 formed in the hindfoot region 206 and the midfoot region 204 and a vamp 214 disposed between the medial quarter 210 and the lateral quarter 212. The vamp 214 extends from the forefoot region 202 to the opening 208 and provides at least one strike or striking region/zone on the top 150 of shoe 100 that may be an ideal location for making contact with an object (e.g., soccer ball) while kicking (e.g., when the shoe 100 is configured as a soccer cleat or "boot"). In some embodiments, the upper 200 may be a composite textile and each part or portion of the upper 200 (e.g., lateral quarter 212 and medial quarter 210) may be formed uniformly (e.g., as a single piece or single section). However, in other embodiments, the upper 200 may be formed from any material or combination of materials and/or may be formed from multiple pieces or parts that are combined or coupled together in any suitable manner.

The opening 208 provides access to an interior cavity of the upper 200; however, in order to more easily receive or accommodate a foot, the upper 200 may also include a selectively openable fastening 152 between the lateral quarter 212 and medial quarter 210. The openable fastening 152 may be closable with a fastener or actuator 154. In some embodiments, the upper 200 may further include a housing or garage 156 (see FIG. 5) for the fastener 154 in order to decrease or eliminate any unwanted contours on the outer surface of the upper 200. Moreover, in some embodiments, the openable fastening 152 is disposed primarily on the lateral quarter 212 and/or lateral side 120, so that the openable fastening 152 (as well as the fastener 154) is not disposed in a strike or striking region/zone included on the upper 200 (which may be disposed primarily on the top 150 and medial side 110). For example, in the depicted embodiment, the fastener 154 is a zipper and the openable fastening 152 extends through the forefoot region 202 and midfoot region 204 of the lateral quarter 212, to the opening 208, thereby leaving the majority of the top 105 and medial quarter 210 (typical striking regions for soccer) unaffected (e.g., clean or smoother surfaces).

The upper 200 may possess any dimensions (size/shape) suitable for its described purpose. For example, the upper 200 may possess a low top configuration in which the upper extends beneath the wearer's ankle, as illustrated in FIGS. 1-5. Alternatively, in other embodiments, the upper 200 may possess a "mid top" configuration (in which the upper extends to slightly below or at the wearer's ankle), a "high top" configuration (in which a hindfoot region 206 of the upper extends over and/or above at least a portion of a wearer's ankle), or any other suitable configuration.

Still referring to FIGS. 1-5, the upper 200 is coupled to the sole structure 270 via any conventional and/or other suitable manner (e.g., via any form of adhesion or bonding, via a woven connection, via one or more types of fasteners, etc.). In the particular embodiment depicted in FIGS. 1-5, the sole structure 270 includes an outsole structure 274 with cleats 276. More specifically, the outsole structure 274 is a preformed plate, with embedded cleats 276, that is coupled directly to the upper 200 (e.g., to the bed 201). The outsole 274 may be constructed from a material that is durable and contains a durometer value greater than the upper 200 and the outsole 274 may be configured to cover the entire bottom surface of the upper 200. Collectively, the upper 200 and the outsole structure 274 provide features of suitable cushioning and comfort while maintaining adequate support and protection for a wearer of the shoe 100.

In other embodiments, the outsole 274 may be separated into multiple regions that are positioned on the upper 200 at locations that receive the most wear. Additionally or alternatively, in other embodiments, the sole structure 270 may include a midsole structure between the upper 200 and the outsole structure 274, such that the outsole structure 274 is coupled to a midsole structure and the midsole structure is coupled to the upper 200. In these embodiments, the midsole structure may provide features for suitable cushioning and comfort.

Figure 6:
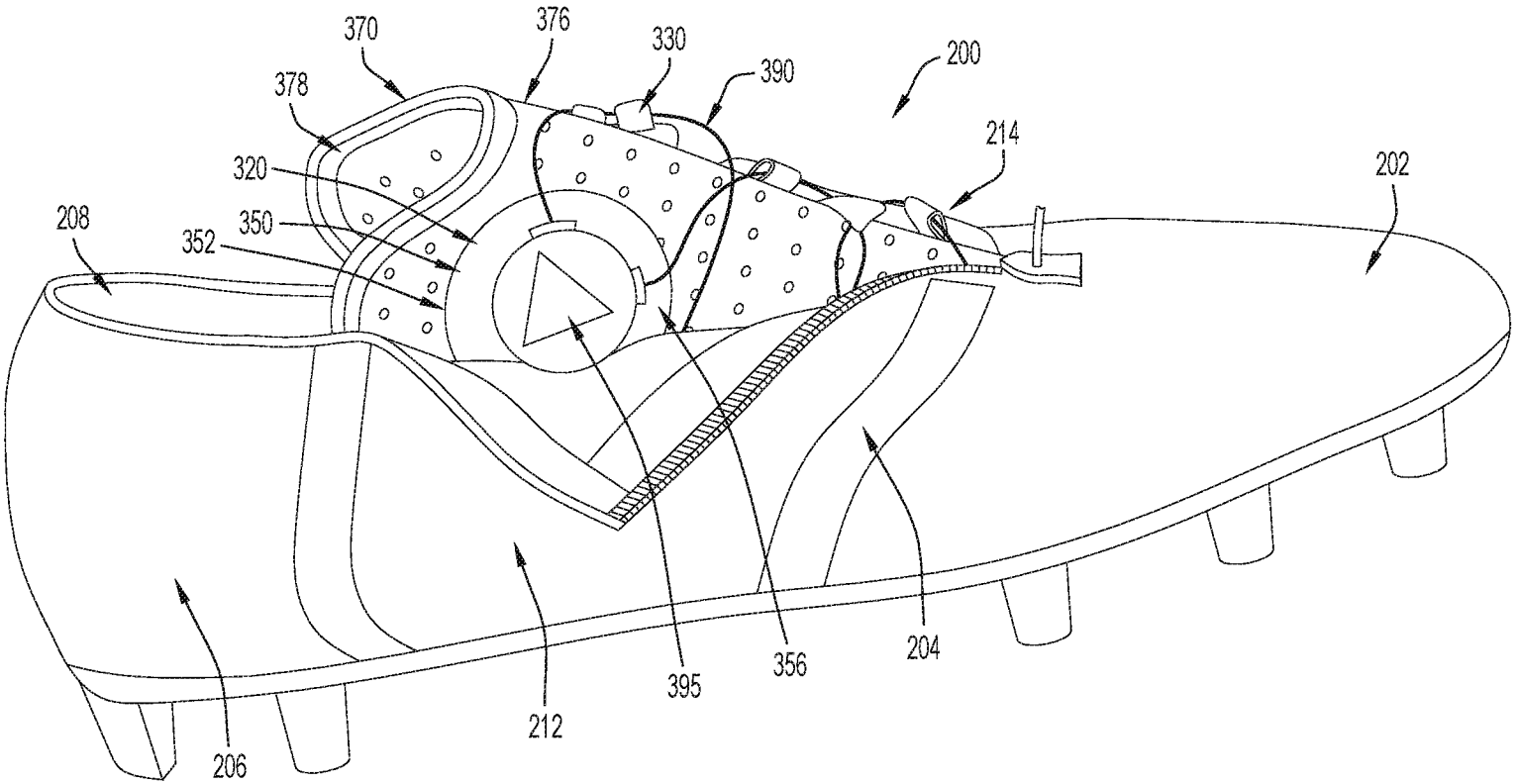
FIG. 6 illustrates a side view of the lateral side of the article of footwear of FIG. 1 with the internal harness partially exposed.
Figure 7:
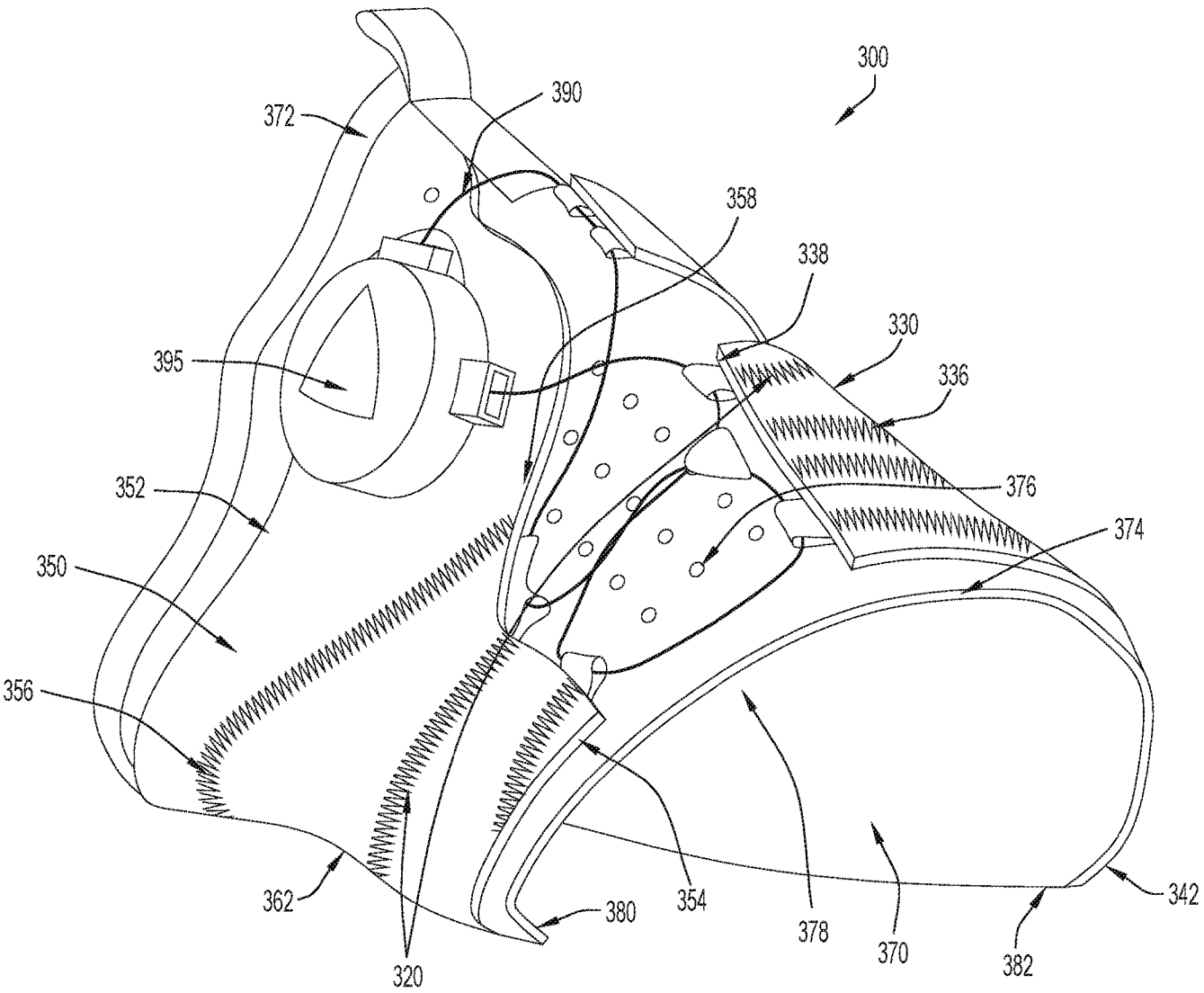
FIG. 7 illustrates a lateral side perspective view of the internal harness from the footwear of FIG. 1 removed from the upper.
Figure 8:
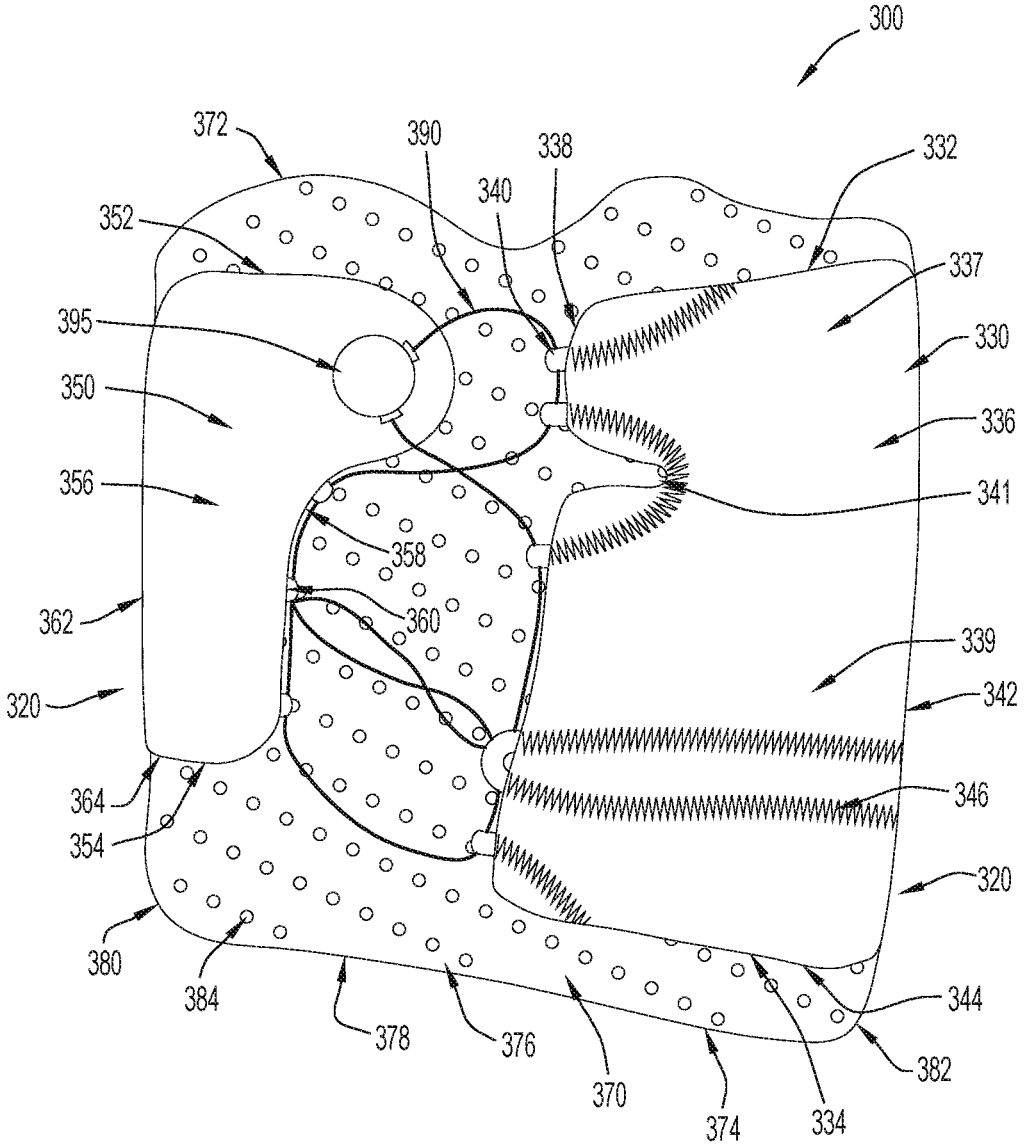
FIG. 8 illustrates a top view of the internal harness from the footwear of FIG. 1 while laying flat and removed from the upper.

Now referring to FIGS. 6-8 for a description of an example embodiment of an internal harness 300 that may be included within the upper 200 (e.g., enclosed or embedded within the upper 200 and/or disposed beneath the upper 200). Reference is also made to FIGS. 1-5 for purposes of the description of FIG. 6-8. The internal harness 300 includes an external layer 320, which may also be referred to herein as a compressive layer, and an internal layer 370 that is or resembles a tongue.

The internal layer 370 may be or include a mesh or a cushioned material so that when the internal layer 370 is compressed or contracted around a wearer's foot, the internal layer 370 provides cushioning, both for comfort and to maintain proper circulation in the wearer's foot (e.g., to ensure that a cable, lace or wire is not tightened directly around a wearer's foot). The external layer 320 includes a medial panel 330 and a lateral panel 350. In the depicted embodiment, the medial panel 330 includes a first section 337 and a second section 339 with a slight recess or indentation 341 formed therebetween, while the lateral panel 350 supports a tightening mechanism 395. The medial panel 330 and lateral panel 330 are coupled together by laces, a cable, or some other mating element 390 that can be selectively tightened by the tightening mechanism 395. In this embodiment, the configuration provided by the first section 337, second section, and recess 341 may generally allow the medial panel 330 to tighten effectively when the tightening mechanism 395 tightens a cable 390; however, in other embodiments, the medial panel 330 need not include sections or a recess and may still be configured to effectively tighten or cause the internal harness to tighten/compress around a wearer's foot.

As shown best in perspective view of FIG. 7 and the top plan view of FIG. 8, the medial panel 330 includes a top surface 336 disposed adjacent the upper 200 and a bottom surface 344 (see FIG. 8) disposed adjacent the internal layer 370, while the lateral panel 350 includes a top surface 356 disposed adjacent the upper 200 and a bottom surface 364 (see FIG. 8) disposed adjacent the internal layer 370. Additionally, the medial panel 330 extends from a first end 332 to a second end 334 while the lateral panel 350 extends from a first end 352 to a second end 354. The first ends 332 and 352 are disposed adjacent the opening 208 of the shoe while the second ends 334 and 354 are disposed in or adjacent the forefoot region 202 of the shoe 100. Consequently, the medial panel 330 and the lateral panel 350 each substantially extend across the midfoot region 204, with the medial panel 330 extending along the medial quarter 210 and the lateral panel 350 extending along the lateral quarter 212. However, preferably, the medial panel 330 and the lateral panel 350 are asymmetrical panels, with the lateral panel 350 being shorter than the medial panel 330 (e.g., the medial panel 330 has a length that is greater than the length of the lateral panel 350). This configuration allows the external layer 320 to more accurately conform to or fit the natural asymmetry of a human foot.

Moreover, the medial panel 330 may be configured to extend further than the lateral panel 350 over the top 150 of the shoe 100 in order to further conform to or fit the natural asymmetry of a human foot. In other words, medial panel 330 is taller than lateral panel 350. In particular, the medial panel 330 may extend from a base edge 342 to a mating edge 338 while the lateral panel 350 extends from a base edge 362 to a mating edge 358. Although not precisely to scale, FIG. 8 illustrates how the distance between base edge 342 and mating edge 338 may be larger than the distance between base edge 362 and mating edge 358. In one example, the distance between base edge 362 and mating edge 358 may be approximately 20 mm while the distance between base edge 342 and mating edge 338 may be approximately 80 mm.

Regardless of the dimensions of the medial panel 330 and lateral panel 350, the base edges 345, 362 may be coupled or configured to be coupled to the bed 201 of the upper 200 while the mating edges 338, 358 may be configured to be coupled together by a cable, laces, or other such mating element. In the particular embodiment shown in FIGS. 6-8, mating edge 338 includes eyelets 340 while mating edge 358 includes eyelets 360. Eyelets 340 and eyelets 360 are each configured to receive a mating element 390 (e.g., a cable) that is weaved therebetween until the mating element 390 is fed into the tightening mechanism 395. In this particular embodiment, eyelets 340 are secured to the mating edge 338 of the medial panel 330 with stitching 346 that extends from the base edge 342 along the top surface 336 while eyelets 360 are secured to the mating edge 358 of the lateral panel 350 with stitching (not shown) that extends from the base edge 362 along the bottom surface 364 of the lateral panel 350. This stitching configuration may ensure that eyelets 340 and eyelets 360 remain attached to their respective panel when the mating element 390 is tightened and exerts a tensioning force on eyelets 340 and eyelets 360 to create a downward compressive force on the internal layer 370 (compressing a wearer's foot against the bed 201 of the upper 200). However, in other embodiments, eyelets 340 and eyelets 360 may be secured to their respective panel in any desirable manner which allows the mating element 390 (e.g., a cable) to be tightened and create a compressive force on the internal layer 370.

The tightening mechanism 395 may be configured to selectively tighten or release the mating element 390 (e.g., a cable) as needed. For example, in one embodiment, twisting or turning the tightening mechanism 395 in a clockwise direction may tighten the mating element 390 while pulling a portion of the tightening mechanism 395 away from the lateral panel 350 may release or loosen the mating element 390. Tightening the mating element 390 causes the medial panel 330 and lateral panel 350 to extend, stretch, or otherwise move towards each other while creating a compressive force downwards towards the bed 201 of the upper 200. Consequently, as the mating element 390 is tightened, the internal harness 300 tightens around the foot of a wearer. As mentioned above, this tightening may lock the foot of a wearer into the bed 201 of the upper 200 to prevent shifting or translation of the wearer's foot (thereby locking the foot to the sole structure 270). The tightening may also lock the wearer's foot into a heel of the upper 200.

Since the tightening mechanism 395 is disposed on the top surface 356 of the lateral panel 350 and adjacent the first end 352 of the lateral panel 350, the tightening mechanism 395 is disposed on the lateral side 120 of the shoe 100, adjacent the opening 208, and beneath the midfoot region 204 of the upper 200. This location may provide a number of advantages. For example, the location may ensure that the tightening mechanism is not in a strike zone included on the shoe, such as vamp 214, which may particularly advantageous when the shoe 100 is a soccer cleat. Moreover, this location may be biomechanically easier for a wearer to reach, as it is easier for a wearer to reach an upper lateral portion of the foot than other portions of the foot, such as portions of the foot that require the wearer to bend over the foot. The location may also be easy to access with a composite upper 200, due to its proximity to the opening 208. Consequently, the wearer can easily adjust the tightness of the internal harness 300. Still further, this location will typically be disposed over a flat planar surface of the foot, which allows the wearer to easily feel the pressure that the internal harness 300 is applying to the foot as the wearer tightens the internal harness 300 at the adjustment mechanism 395. Consequently, the wearer can easily achieve the proper tightness without repeated adjusting and testing.

Still referring to FIGS. 6-8, the internal layer 370 includes a top surface 376 and a bottom surface 378 that each extend between a first end 372 and a second end 374. The top surface 376 is adjacent the outer layer 320 while the bottom surface 378 is adjacent a wearer's foot so that the internal layer can impart a compressive force from the external layer 320 to a wearer's foot. The internal layer 370 may be secured to the upper 200 and/or the external layer 320 along a first edge 380 and a second edge 382 in any manner. For example, as shown best in FIG. 7, the first edge 380 may secured to the base edge 362 of the lateral panel 350 and/or an edge of the bed 201 on the lateral side 120 of the upper 200. Meanwhile, the second edge 382 may be secured the base edge 342 of the medial panel 330 and/or an edge of the bed 201 on the medial side 110 of the upper 200. Additionally, the internal layer 370 may include a plurality of apertures 384 in order to provide features such as suitable ventilation, increased comfort and flexibility.

Now referring to FIGS. 9-11 for a description of another embodiment of an internal harness 400 that may be included within an upper 200 (e.g., enclosed or embedded within the upper 200 and/or disposed beneath the upper 200). Reference is also made to FIGS. 1-5 for purposes of the description of FIG. 9-11, despite the internal harness 400 being included in a left footed shoe (while the shoe 100 from FIGS. 1-5 is a right footed shoe). Similar to internal harness 300, the internal harness 400 includes an external layer 420, which may also be referred to herein as a compressive layer, and an internal layer 470 that is or resembles a tongue. Consequently, the internal layer 470 may be or include a mesh or a cushioned material so that when the internal layer 470 is compressed or contracted around a wearer's foot, the internal layer 470 provides cushioning, both for comfort and to maintain proper circulation in the wearer's foot (e.g., to ensure that a cable, lace or wire is not tightened directly around a wearer's foot). The external layer 420 also includes a medial panel 430 and a lateral panel 450, similar to external layer 320, but neither panel includes sections and neither panel includes a tightening mechanism. Instead, the medial panel 430 and lateral panel 450 are coupled together by laces, a cable, or some other mating element 490, such as shoelace, that can be selectively tightened by the wearer.

As shown best in the top plan view of FIG. 11 and the perspective view of FIG. 10, the medial panel 430 includes a top surface 436 disposed adjacent the upper 200 and a bottom surface 444 disposed adjacent the internal layer 470. Meanwhile, and as shown best in the top plan view of FIG. 11 and the perspective view of FIG. 9, the lateral panel 450 includes a top surface 456 disposed adjacent the upper 200 and a bottom surface 464 disposed adjacent the internal layer 470. Additionally, the medial panel 430 extends from a first end 432 to a second end 434 while the lateral panel 450 extends from a first end 452 to a second end 454. The first ends 442 and 452 are again disposed adjacent the opening 208 of the shoe while the second ends 434 and 454 are disposed in or adjacent the forefoot region 202 of the shoe 100. Consequently, the medial panel 430 and the lateral panel 450 each substantially extend across the midfoot region 204, with the medial panel 430 extending along the medial quarter 210 and the lateral panel 450 extending along the lateral quarter 212. Again, preferably, the medial panel 430 and the lateral panel 450 are asymmetrical panels, with the lateral panel 450 being shorter than the medial panel 430. This configuration allows the external layer 420 to more accurately conform to or fit the natural asymmetry of a human foot.

Moreover, the medial panel 430 may be configured to extend further than the lateral panel 450 over the top 150 of the shoe 100 in order to further conform to or fit the natural asymmetry of a human foot. In particular, the medial panel 430 may extend from a base edge 442 to a mating edge 438 while the lateral panel 450 extends from a base edge 462 to a mating edge 458. Although not precisely to scale, FIG. 11 illustrates how the distance between base edge 442 and mating edge 438 may be larger than the distance between base edge 462 and mating edge 458. In one example, the distance between base edge 462 and mating edge 458 may be approximately 20 mm while the distance between base edge 442 and mating edge 438 may be approximately 80 mm.

Regardless of the dimensions of the medial panel 430 and lateral panel 450, the base edges 442 and 462 may be coupled or configured to be coupled to the bed 201 of the upper 200 while the mating edges 438, 458 may be configured to be coupled together by a cable, laces, or other such mating element 490. In the particular embodiment shown in FIGS. 9-11, mating edge 438 includes eyelets 440 while mating edge 458 includes eyelets 460. Eyelets 440 and eyelets 460 are each configured to receive a mating element 490 (e.g., a shoelace) that is weaved therebetween until the laces extend away from the external layer 420 (adjacent opening 208). In this particular embodiment, eyelets 440 are secured to the mating edge 438 of the medial panel 430 with stitching 446 that extends from the base edge 442 along the top surface 446 while eyelets 460 are secured to the mating edge 458 of the lateral panel 350 with stitching 466 that extends from the base edge 462 along the top surface 456 of the lateral panel 450. This configuration may ensure that eyelets 440, 460 remain attached to their respective panel when the mating element 490 (e.g., laces) is tightened and exert a tensioning force on eyelets 440 and eyelets 460 to create a downward compressive force on the internal layer 370 (compressing a wearer's foot against the bed 201 of the upper 200). However, in other embodiments, eyelets 440 and eyelets 460 may be secured to their respective panel in any desirable manner which allows the mating element 490 (or other such mating element) to be tightened and create a compressive force on the inner layer 420.

Although this embodiment does not include a tightening mechanism such as depicted in the embodiment of FIGS. 6-8, the mating element 490 may be tightened by pulling or tensioning different portions of the mating element 490. As the mating element 490 is tightened, the medial panel 430 and lateral panel 450 extend, stretch, or otherwise move towards each other while creating a compressive force downwards towards the bed 201 of the upper 200, such that the internal harness 400 tightens around the foot of a wearer. As mentioned above, this tightening may lock the foot of a wearer into the bed 201 of the upper 200 to prevent shifting or translation of the wearer's foot. The tightening may also lock the wearer's foot into the heel of the upper 200 (thereby locking the foot to the sole structure 270).

Still referring to FIGS. 9-11, the internal layer 470 includes a top surface 476 and a bottom surface 478 that each extend between a first end 472 and a second end 474. The top surface 476 is adjacent the outer layer 420 while the bottom surface 478 is adjacent a wearer's foot, so that the internal layer can impart a compressive force from the external layer 420 to a wearer's foot. The internal layer 470 may be secured to the upper 200 and/or the external layer 420 along a first edge 480 and a second edge 482 in any manner. For example, the first edge 480 may secured to the base edge 462 of the lateral panel 450 and/or an edge of the bed 201 on the lateral side 120 of the upper 200. Meanwhile, the second edge 482 may be secured to the base edge 442 of the medial panel 430 and/or an edge of the bed 201 on the medial side 110 of the upper 200. Additionally, the internal layer 470 may include a plurality of apertures 484 in order to provide increased comfort and flexibility.

Thus, the internal harness implemented within or as part of an upper provides a number of benefits including, without limitation, easy tightening of the user's foot within the upper so as to lock the user's foot down within the foot bed and/or foot cavity within the shoe and enhance speed and performance of the user during movements. The locking down of the user's foot within the shoe also minimizes or prevents forward translation of foot within foot shoe cavity (e.g., analogous to a "seat belt" around the foot when wearing the shoe) and also keeps the user's heel engaged in heel pocket of the cavity (at the heel end of the shoe).

While the invention has been described in detail and with reference to specific embodiments thereof, it will be apparent to one skilled in the art that various changes and modifications can be made therein without departing from the spirit and scope thereof.

For example, while the harness in the embodiments described herein is internal (i.e., within or underneath) the shoe upper, an external harness (i.e., a harness that is external to or provided over portions of the shoe upper) can also be provided having otherwise similar structural features as the internal harness described herein. Any suitable fastener mechanism or mating element can be used to pull, stretch or force portions (e.g., lateral and medial side portions) of the harness together to force or "lock down" the user's foot within the shoe cavity so as to minimize or prevent forward translation of the foot during use of the shoe. The harness can be constructed of any one or more suitable materials, including materials similar to or different from the materials used to construct the upper.

Moreover, the harness described herein may be provided as a stand-along element and may be installable into a variety of uppers in order to retrofit these uppers with the harness. In these embodiments, the inner/internal layer and the external/outer layer may be coupleable to an upper (e.g., the medial panel may be coupleable to a medial side of an upper and the lateral panel may be coupleable to a lateral side of the upper). Still further, some embodiments need not include an inner or internal layer.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. An article of footwear comprising:

an upper having a midfoot region, a forefoot region, a medial side, a lateral side, a top disposed between the medial side and the lateral side, and an opening configured to receive a foot of a wearer, the top and the medial side of the upper defining a strike area of the article of footwear; and a harness extending between the midfoot region and the forefoot region, and including:

a tongue that is coupleable to the medial side and the lateral side of the upper;

a compressive layer including a cable; and a rotary tightening mechanism configured to tension the cable, which causes the tongue to apply a compressive force to the foot of a wearer to secure the foot of the wearer in the upper, wherein the cable and the rotary tightening mechanism are disposed closer to the lateral side of the upper than the medial side of the upper so that the cable and the rotary tightening mechanism do not impact an outer contour of the strike area.

2. The article of footwear of claim 1, wherein the rotary tightening mechanism is disposed adjacent the opening beneath a lateral quarter included on the lateral side of the upper.

3. The article of footwear of claim 1, wherein the upper further comprises a bed and the harness is further configured to secure the foot of the wearer to the bed.

4. The article of footwear of claim 3, further comprising:

a sole structure coupled to the bed, and the harness is configured to secure the foot of the wearer to the sole structure.

5. The article of footwear of claim 4, wherein the sole structure includes a plurality of cleats.

6. The article of footwear of claim 1, wherein the tongue is coupled to the upper in one or more locations.

7. The article of footwear of claim 1, wherein the cable spans a width of the tongue and the rotary tightening mechanism tightens the cable along the width of the tongue in response to a single rotation.

8. An article of footwear comprising:

an upper having a bed and defining an interior cavity configured to receive a foot of a wearer, the bed having a medial side and a lateral side, and the upper including a top disposed between the medial side of the bed and the lateral side of the bed, wherein the upper defines a strike area between the top of the upper and the medial side of the bed; and a harness including:

a tongue that forms an inner layer coupled to the medial side and the lateral side of the bed of the upper; and a compressive outer layer extending over the inner layer and including a cable and a rotary tightening mechanism, the rotary tightening mechanism configured to tension the cable, which causes the outer layer to apply a compressive force to the inner layer to secure the foot of the wearer to the bed of the upper, wherein the cable and the rotary tightening mechanism are disposed closer to the lateral side of the bed than the medial side of the bed so that the cable and the rotary tightening mechanism do not impact an outer contour of the strike area.

9. The article of footwear of claim 8, wherein the upper further comprises:

a sole that is coupled to a bottom side of the bed, the harness being configured to secure the foot of the wearer to the bed and the sole.

10. The article of footwear of claim 9, wherein sole includes an outsole with a plurality of cleats.

11. The article of footwear of claim 8, wherein the rotary tightening mechanism is positioned adjacent an opening to the interior cavity.

12. The article of footwear of claim 8, wherein the cable spans a width of the outer layer, and wherein the rotary tightening mechanism tightens the cable along the width of the outer layer in response to a single rotation.

13. The article of footwear of claim 8, wherein the outer layer further comprises:

a medial panel coupled to the medial side of the bed; and a lateral panel coupled to the lateral side of the bed and movably coupled to the medial panel, wherein moving the lateral panel and the medial panel together applies the compressive force to the inner layer.

14. The article of footwear of claim 13, wherein, when the rotary tightening mechanism tensions the cable, the cable moves the lateral panel and the medial panel together.

15. An internal harness for an article of footwear, comprising:

a tongue that is coupleable to a medial side and a lateral side of an upper;

a compressive layer disposed over the tongue;

a cable disposed in or over the compressive layer; and a rotary tightening mechanism disposed on the tongue closer to the lateral side of the upper than the medial side of the upper and configured to tighten the cable, which causes the tongue to apply a compressive force to a foot of a wearer to secure the foot of the wearer in the upper, wherein the tongue provides a cushioning layer between the cable and the foot of the wearer to provide comfort for and maintain circulation in the foot of the wearer.

16. The internal harness of claim 15, wherein the cable spans a width of the tongue and the rotary tightening mechanism tightens the cable along the width of the tongue in response to a single rotation.

17. The internal harness of claim 15, wherein the cable is closer to the lateral side of the upper than the medial side of the upper and neither the cable nor the rotary tightening mechanism impacts an outer contour of a strike area defined by a vamp and a medial quarter of the upper.

* * * * *